US009511962B2

(12) United States Patent
Tanaka et al.

(10) Patent No.: US 9,511,962 B2
(45) Date of Patent: Dec. 6, 2016

(54) SHEET FEEDING DEVICE AND IMAGE FORMING APPARATUS

(71) Applicants: Mizuna Tanaka, Osaka (JP); Ippei Kimura, Osaka (JP); Ikuo Fujii, Osaka (JP); Hirofumi Horita, Osaka (JP); Tomoya Tanaka, Osaka (JP)

(72) Inventors: Mizuna Tanaka, Osaka (JP); Ippei Kimura, Osaka (JP); Ikuo Fujii, Osaka (JP); Hirofumi Horita, Osaka (JP); Tomoya Tanaka, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/669,615

(22) Filed: Mar. 26, 2015

(65) Prior Publication Data

US 2015/0274452 A1 Oct. 1, 2015

(30) Foreign Application Priority Data

Mar. 28, 2014 (JP) ..... 2014-068388

(51) Int. Cl.

*B65H 3/52* (2006.01)
*B65H 3/06* (2006.01)
*B65H 3/68* (2006.01)

(52) U.S. Cl.

CPC ..... *B65H 3/5223* (2013.01); *B65H 3/06* (2013.01); *B65H 3/68* (2013.01); *B65H 2402/10* (2013.01); *B65H 2404/61* (2013.01); *B65H 2601/521* (2013.01); *B65H 2601/522* (2013.01); *B65H 2601/524* (2013.01)

(58) Field of Classification Search

CPC ..... B65H 3/46; B65H 3/52; B65H 3/5207; B65H 3/5215; B65H 3/5223; B65H 3/68; B65H 3/5238; B65H 3/523; B65H 2404/511; B65H 2404/5131; B65H 2404/521; B65H 2404/5211; B65H 2404/5214; B65H 2404/522; B65H 2404/53; B65H 2404/531; B65H 2404/5521; B65H 2404/55; B65H 2404/551; B65H 2404/5511; B65H 2404/552

See application file for complete search history.

(56) References Cited

U.S. PATENT DOCUMENTS 6,371,477 B1 * 4/2002 Lin ..... B65H 3/5223 271/121
6,824,131 B2 * 11/2004 Togashi ..... B65H 1/266 271/121
7,497,432 B2 * 3/2009 Ikeda ..... B65H 3/0661 271/121
7,731,177 B2 * 6/2010 Ikeda ..... B65H 3/0661 271/121
8,752,832 B2 * 6/2014 Mitamura ..... B65H 9/002 271/264
2007/0273085 A1 11/2007 Nanno et al.

(Continued)

FOREIGN PATENT DOCUMENTS

JP 2000-198560 7/2000
JP 2004-189350 7/2004

(Continued)

*Primary Examiner* — Ernesto Suarez
(74) *Attorney, Agent, or Firm* — Harness, Dickey & Pierce, P.L.C.

(57) ABSTRACT

A sheet feeding device includes a rotary feeder to contact a first side of a sheet to feed the sheet downstream along a feed passage; a friction pad disposed opposing the rotary feeder with the feed passage interposed between the rotary feeder and the friction pad to form a separation nip, the friction pad having a first side facing the separation nip and a second side opposite the first side of the friction pad; a holder disposed on the second side of the friction pad and having a first side holding the friction pad and a second side opposite the first side of the holder; a guide support disposed on the second side of the holder; and a pair of guides disposed on the guide support to contact a second side of the sheet facing the friction pad to raise the sheet from a surface of the friction pad.

20 Claims, 11 Drawing Sheets

(56) References Cited

U.S. PATENT DOCUMENTS

| | | | | |
|---|---|---|---|---|
| 2008/0224385 | A1 | 9/2008 | Takahira et al. | |
| 2008/0237970 | A1 | 10/2008 | Tanaka et al. | |
| 2009/0315250 | A1 | 12/2009 | Kimura et al. | |
| 2010/0019440 | A1 | 1/2010 | Fujiwara et al. | |
| 2010/0059930 | A1 | 3/2010 | Tanaka et al. | |
| 2010/0221051 | A1 | 9/2010 | Yamazaki et al. | |
| 2010/0225041 | A1 | 9/2010 | Matsuyama et al. | |
| 2011/0115154 | A1 | 5/2011 | Fujiwara et al. | |
| 2011/0204556 | A1 | 8/2011 | Takahira et al. | |
| 2012/0061907 | A1 | 3/2012 | Matsuyama et al. | |
| 2012/0063829 | A1 | 3/2012 | Matsuyama et al. | |
| 2012/0104690 | A1 | 5/2012 | Tanaka et al. | |
| 2012/0146281 | A1 | 6/2012 | Nishii et al. | |
| 2013/0043647 | A1 | 2/2013 | Fujii et al. | |
| 2014/0049000 | A1* | 2/2014 | Kimura | B65H 3/5223 271/3.14 |
| 2014/0077444 | A1 | 3/2014 | Fujii et al. | |
| 2014/0197593 | A1* | 7/2014 | Machii | B65H 3/5261 271/121 |
| 2014/0319759 | A1 | 10/2014 | Fujii et al. | |
| 2015/0274450 | A1* | 10/2015 | Fujii | B65H 3/06 271/127 |

FOREIGN PATENT DOCUMENTS

| | | |
|---|---|---|
| JP | 2005-008396 | 1/2005 |
| JP | 2005-343582 | 12/2005 |

* cited by examiner

SHEET FEEDING DEVICE AND IMAGE FORMING APPARATUS

CROSS-REFERENCE TO RELATED APPLICATIONS

This patent application is based on and claims priority pursuant to 35 U.S.C. §119(a) to Japanese Patent Application No. 2014-068388, filed on Mar. 28, 2014, in the Japan Patent Office, the entire disclosure of which is incorporated by reference herein.

BACKGROUND

Technical Field

Embodiments of the present disclosure relate to a sheet feeding device incorporated in an image forming apparatus, such as a copier, a facsimile machine, a printer, a printing press, a multifunction peripheral, or an inkjet recording apparatus, and an image forming apparatus incorporating the sheet feeding device.

Description of the Related Art

As a quality of an image forming apparatus such as a copier, a facsimile machine, or a printer, there is a sheet conveyance quality (a sheet conveyance performance). In recent years, various sheets have been used in image forming apparatuses, and a quality improvement in sheet feeding and separation becomes essential. As a sheet feeding device that performs high-quality sheet feeding and separation, a roller friction (RF) system and a feed and reverse roller (FRR) system are already known.

The roller friction (RF) system and the feed and reverse roller (FRR) system can perform high-quality sheet feeding and separation, but the cost is high, and it is difficult to downsize. Meanwhile, as a relatively low-cost compact sheet feeding device, known is a sheet feeding device of a friction pad system (separation pad system).

BRIEF SUMMARY

In an aspect of this disclosure, there is provided a sheet feeding device including a rotary feeder, a friction pad, a holder, a guide support, and a pair of guides. The rotary feeder contacts a first side of a sheet to feed the sheet downstream along a feed passage. The friction pad is disposed opposing the rotary feeder with the feed passage interposed between the rotary feeder and the friction pad to form a separation nip. The friction pad has a first side facing the separation nip and a second side opposite the first side of the friction pad. The holder is disposed on the second side of the friction pad and has a first side holding the friction pad and a second side opposite the first side of the holder. The guide support is disposed on the second side of the holder. The pair of guides are disposed on the guide support to contact a second side of the sheet facing the friction pad to raise the sheet from a surface of the friction pad.

In an aspect of this disclosure, there is provided an image forming apparatus including the sheet feeding device, an image forming device to form an image on the sheet fed with the rotary feeder; and a sheet ejector to eject the sheet on which the image is formed with the image forming device to an outside of the image forming apparatus.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
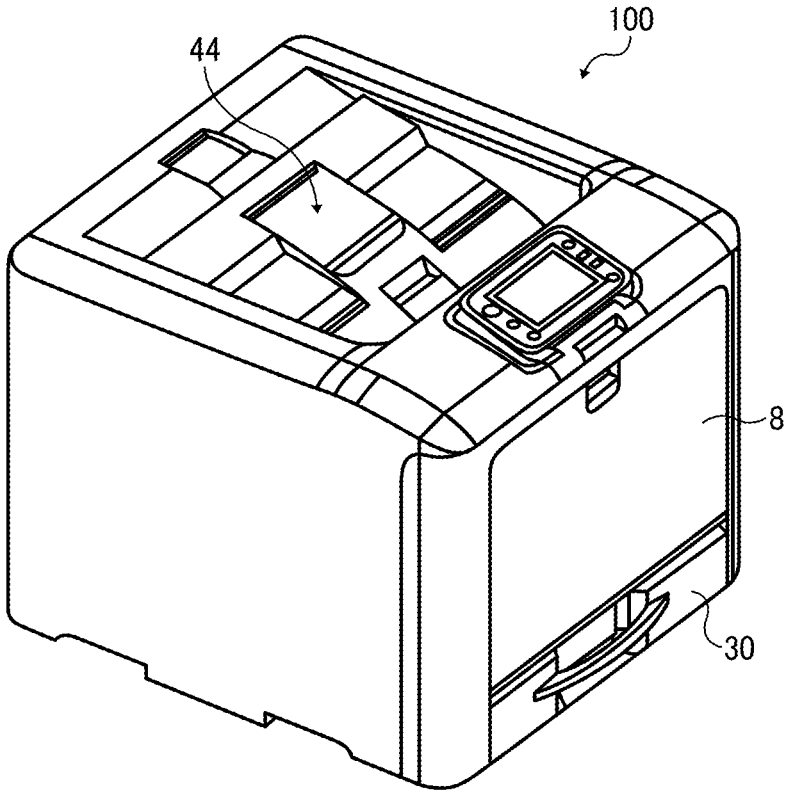
FIG. 1 is a perspective view of a color laser printer serving as an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity.

However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, an exemplary embodiment of the present disclosure will be described with reference to the appended drawings. In the drawings, the same or corresponding parts are denoted by the same reference numerals, and a redundant description thereof is appropriately simplified or omitted.

In this description, the term "sheet" is not limited to a sheet of paper, and includes a medium to which developer or ink adheres such as an overhead projector (OHP) sheet or fabric, a recorded medium, a recording medium, a recording sheet, a recording sheet of paper, and the like. Further, the "sheet" is not limited to a flexible one and also includes a hard plate-like one or a relatively thick one.

Further, for example, a dimension, a material, a shape, and a relative arrangement of components used in description of components are an example, and not intended to limit the scope of the claimed invention particularly unless set forth specifically.

In a friction pad system, a holder with a friction pad (a separation pad) serving as a friction member attached thereto is arranged below a feed roller. A material (for example, natural rubber, a cork material, leather, a urethane material, synthetic rubber, or the like) having a friction coefficient smaller than a friction coefficient of the feed roller is used as a material of the friction pad.

In the friction pad system, a sheet fed from an uppermost layer of a bundle of sheets loaded on a sheet load plate by the feed roller is caused to contact the friction pad in order to suppress multi-feeding of sheets by friction between the friction pad and the sheet. Then, only an uppermost sheet contacting the feed roller is separated and fed toward an image forming device one by one.

At the time of separation and feeding, if upward pressing force (hereinafter, referred to as "sheet feeding pressure") of the sheet load plate is too strong, since a sheet supply capability by the feed roller is increased, the sheets are multifed without being separated by the friction member. Further, if the sheet feeding pressure is too weak, the sheet supply capability is lower than a conveyance load by the friction member or the like, and thus a feeding failure in which it is difficult to feed a sheet occurs.

Meanwhile, if pressing force (hereinafter, referred to as "separation force") of the holder of the friction member is too weak, friction sufficient to separate the sheet is not obtained, and the sheets are multifed. Further, if the separation force is too strong, a noise occurs due to a stick slip between the friction member and the sheet. In order to prevent the occurrence of this problem, it is necessary to set proper ranges of sheet feeding pressure and separation force.

However, the proper ranges of the sheet feeding pressure and the separation force differ according to a sheet type such as a thick sheet or a thin sheet. Commonly, since the thick sheet has strong stiffness and thus a large conveyance load, the thick tends to be disadvantageous against the feeding failure. Due to the opposite reasons, the thin sheet tends to be disadvantageous against multifeeding.

In order to prevent this, for example, the conveyance force is secured by setting the sheet feeding pressure to be high, and the separation force is set to be high in order to further secure separability. However, as described above, if the separation force is set to be too high, noise is likely to be caused by the friction member.

(Configuration of Laser Printer)

Figure 2:
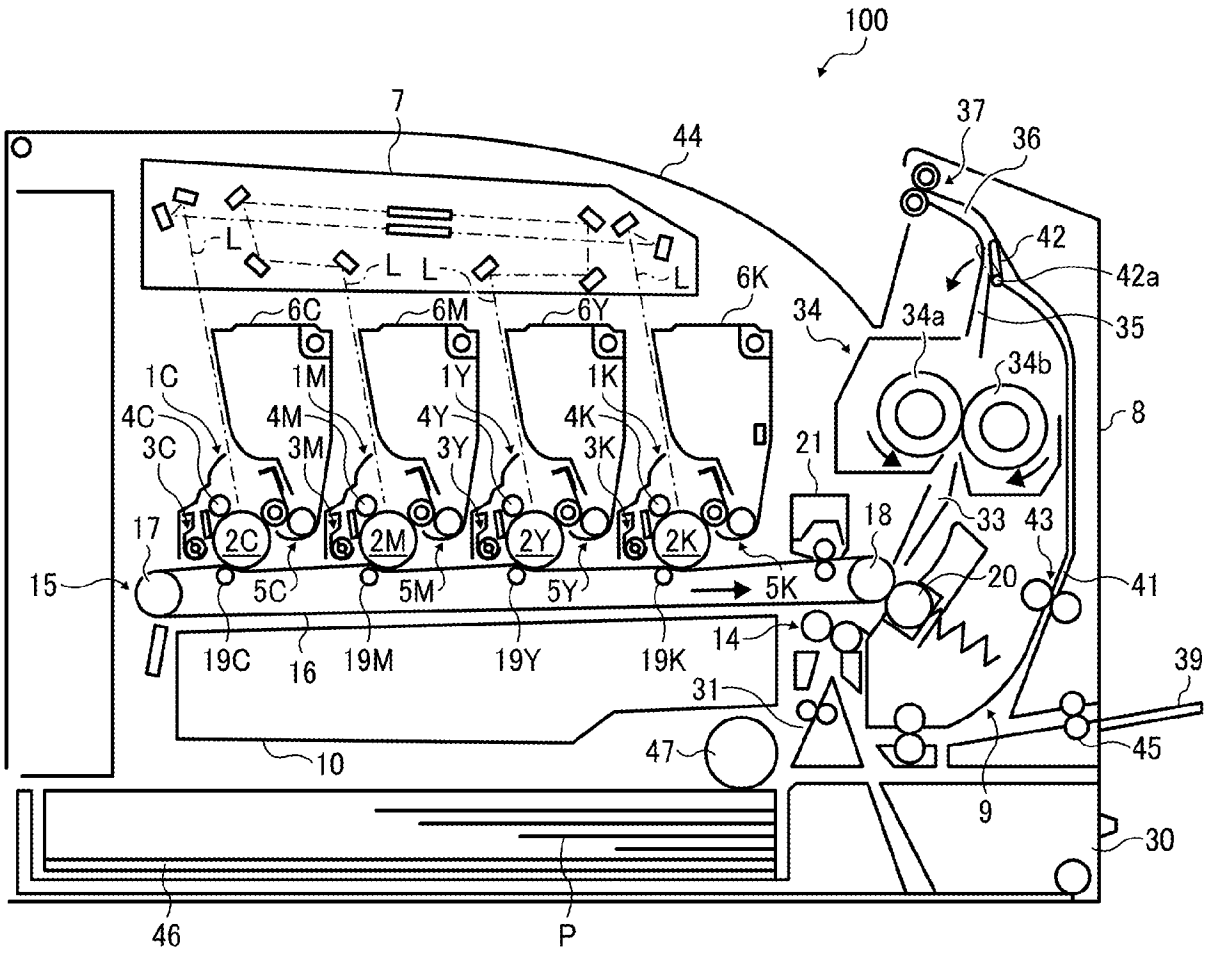
FIG. 2 is a schematic inner structure diagram of a color laser printer according to an embodiment of the present disclosure.

A sheet feeding device according to an embodiment of the present disclosure can be applied, for example, to a sheet feeding device of an image forming apparatus or an image reading device. FIGS. 1 and 2 schematically illustrate a configuration of a color laser printer as an image forming apparatus including a sheet feeding device according to an embodiment of the present disclosure. A color laser printer 100 includes four process units 1K, 1Y, 1M, and 1C. The process units 1K, 1Y, 1M, and 1C serving as image forming devices form images using developers of respective colors of black (K), yellow (Y), magenta (M), and cyan (C) corresponding to color separation components of a color image.

The process units 1K, 1Y, 1M, and 1C include toner bottles 6K, 6Y, 6M, and 6C storing unused toners of different colors, respectively, and have a similar configuration. Thus, the following description will proceed with a configuration of one process unit 1K, and a description of the configurations of the other process units 1Y, 1M, and 1C is omitted.

The process unit 1K includes an image bearer 2K (for example, a photoconductor drum), a drum cleaner 3K, a charge neutralizer, a charging device 4K, a developing device 5K, and the like. The process unit 1K is mounted to be removably attachable to the body of the laser printer 100, and configured so that consumables can be simultaneously replaced.

An exposure device 7 is arranged above the process units 1K, 1Y, 1M, and 1C installed in the laser printer 100. The exposure device 7 is configured to cause a laser diode to emit laser light based on image data.

In this embodiment, a transfer device 15 is arranged below the process units 1K, 1Y, 1M, and 1C. Primary transfer rollers 19K, 19Y, 19M, and 19C are disposed in contact with an intermediate transfer belt 16 while facing the image bearers 2K, 2Y, 2M, and 2C.

The intermediate transfer belt 16 is configured to circulate in a state in which it is stretched around the primary transfer rollers 19K, 19Y, 19M, and 19C, a driving roller 18, and a driven roller 17.

A secondary transfer roller 20 is disposed in contact with the intermediate transfer belt 16 while facing the driving roller 18. If the image bearers 2K, 2Y, 2M, and 2C are assumed to be first image bearers of respective colors, the intermediate transfer belt 16 is a second image bearer on which respective images are synthesized.

A belt cleaner 21 is installed downstream in a traveling direction of the intermediate transfer belt 16 further than the secondary transfer roller 20. A cleaning backup roller is installed at a side opposite to the belt cleaner 21 with respect to the intermediate transfer belt 16.

The sheet feed tray 30 is installed below the laser printer 100, and configured to store many bundles of sheets P. The sheet feed tray 30 is removably attachable relative to the body of the laser printer 100 for sheet supply or the like. A sheet feed roller 47 serving as a rotary feeder is arranged above the sheet feed tray 30 in a state installed in the laser printer 100, and configured to feed the sheet P from the sheet feed tray 30 toward a sheet feed passage 31.

A timing roller pair 14 is arranged at an upstream side nearest the secondary transfer roller 20, and can temporarily stop the sheet P fed from the sheet feed tray 30. Due to the temporarily stopping, a leading edge side of the sheet P is slack.

The sheet P that is slack is fed to a secondary transfer separation nip between the secondary transfer roller 20 and the driving roller 18 according to a timing at which a toner image formed on the intermediate transfer belt 16 is suitably transferred. The toner image formed on the intermediate transfer belt 16 is transferred to a desired transfer position of the fed sheet P in the secondary transfer separation nip with a high accuracy.

A post-transfer feed passage 33 is arranged above the secondary transfer separation nip between the secondary transfer roller 20 and the driving roller 18. A fixing device 34 is installed nearby an upper end of the post-transfer feed passage 33.

The fixing device 34 includes a fixing roller 34*a* including a heat source such as halogen lamp therein and a pressure roller 34*b* that rotates while coming into contact with the fixing roller 34*a* by certain pressure. A fixing feed passage 35 is arranged above the fixing device 34, and an upper end of the fixing feed passage 35 is bifurcated into a sheet ejection passage 36 and a reverse feed passage 41.

A switcher 42 is arranged in the bifurcated portion, and the switcher 42 is driven swingably around a swing shaft 42*a*. A sheet ejection roller pair 37 serving as a sheet ejector is arranged nearby an opening end of the sheet ejection passage 36.

The reverse feed passage 41 joins the sheet feed passage 31 at the other end of the bifurcated portion. A reverse feed roller pair 43 is arranged in the middle of the reverse feed passage 41. A sheet ejection tray 44 is installed to form a recessed shape in an inward direction of the laser printer 100 in an upper portion of the laser printer 100.

A powder container 10 (for example, a toner container) is arranged between the transfer device 15 and the sheet feed tray 30. The powder container 10 is mounted to be removably attachable to the body of the laser printer 100.

In the laser printer 100 according to the present embodiment, a certain distance from the sheet feed roller 47 to the secondary transfer roller 20 is needed due to a transfer sheet conveyance relation. The powder container 10 is installed in a dead space formed by this distance in order to downsize the entire laser printer.

A transfer cover 8 is installed at a front side of the sheet feed tray in a drawing direction above the sheet feed tray 30. The inside of the laser printer 100 can be inspected by opening the transfer cover 8. Bypass feed rollers 45 for bypass feeding and a bypass feed tray 39 for bypass feeding are disposed in the transfer cover 8.

The laser printer according to the present embodiment is an example of an image forming apparatus, and the image forming apparatus is not limited to a laser printer. In other words, the image forming apparatus may be configured as one of a copier, a facsimile machine, a printer, a printing press, and an inkjet recording apparatus or a multifunction peripheral in which at least two or more of a copier, a facsimile machine, a printer, a printing press, and an inkjet recording apparatus are combined. The image forming apparatus may be a multifunction peripheral with an image reading device.

(Operation of Color Laser Printer)

Next, a basic operation of the laser printer 100 according to an embodiment of the present embodiment will be described below with reference to FIG. 2.

First, an example in which simplex printing is performed will be described. The sheet feed roller 47 rotates according to a sheet feeding signal given from a controller of the laser printer 100 as illustrated in FIG. 2. Then, the sheet feed roller 47 separate only an uppermost sheet among a bundle of sheets P loaded on the sheet feed tray 30, and feeds the separated sheet to the sheet feed passage 31.

The leading edge of the sheet P fed by the sheet feed roller 47 arrives at the secondary transfer separation nip of the timing roller pair 14, the sheet P is slack and on standby in this state. Then, an attempt to find an optimal timing (synchronization) at which the toner image formed on the intermediate transfer belt 16 is transferred onto the sheet is made, and a leading edge skew of the sheet P is corrected.

When bypass sheet feeding is performed, a bundle of sheets loaded on the bypass feed tray 39 pass through a part of the reverse feed passage 41 one by one starting from an uppermost sheet through the bypass feed rollers 45 and are conveyed up to the secondary transfer separation nip of the timing roller pair 14. A subsequent operation is the same as the sheet feeding from the sheet feed tray 30.

Here, an image formation operation will be described in connection with one process unit 1K, and a description of the other process units 1Y, 1M, and 1C is omitted. First, the charging device 4K uniformly charges the surface of the image bearer 2K to high potential.

Then, the exposure device 7 irradiates the surface of the image bearer 2K with a laser beam L based on image data. Then, in the surface of the image bearer 2K irradiated with the laser beam L, potential of the irradiated portion is lowered, and an electrostatic latent image is formed.

Then, the developing device 5K causes an unused black toner supplied from the toner bottle 6K to migrate to the surface of the image bearer 2K on which the electrostatic latent image is formed. Then, a black toner image is formed (developed) on the surface of the image bearer 2K to which the toner has mitigated. Then, the toner image formed on the image bearer 2K is transferred to the intermediate transfer belt 16.

The drum cleaner 3K removes a residual toner adhering to the surface of the image bearer 2K that has been subjected to the intermediate transfer process. The removed residual toner is fed to and collected in a waste toner storage arranged in the process unit 1K through a waste toner conveyor. The charge neutralizer neutralizes residual charges of the image bearer 2K from which the residual toner has been removed through the drum cleaner 3K.

In the process units 1Y, 1M, and 1C of respective colors, similarly, toner images are formed on the image bearers 2Y, 2M, and 2C and transferred onto the intermediate transfer belt 16 so that toner images of respective colors superimpose on one another.

When the intermediate transfer belt 16 onto which the toner images of respective colors are transferred to superimpose on one another travels up to the secondary transfer separation nip between the secondary transfer roller 20 and the driving roller 18, the toner image on the intermediate transfer belt 16 is transferred onto the sheet P fed by the timing roller pair 14.

Here, the sheet P is fed to the secondary transfer separation nip according to a timing at which the toner image formed on the intermediate transfer belt 16 by the superimposition transfer is suitably transferred. Then, the toner image formed on the intermediate transfer belt 16 is transferred onto a desired transfer position of the fed sheet P in the secondary transfer separation nip with a high accuracy.

The sheet P onto which the toner image is transferred is conveyed to the fixing device 34 through the post-transfer feed passage 33. Then, the sheet P conveyed to the fixing device 34 is interposed between the fixing roller 34*a* and the pressure roller 34*b*, and an unfixed toner image is fixed onto the sheet P by heating and pressurizing. The sheet P onto which the toner image is fixed is fed from the fixing device 34 to the fixing feed passage 35.

The switcher 42 is at a position at which a portion around the upper end of the fixing feed passage 35 is opened at a timing at which the sheet P is fed from the fixing device 34 as indicated by a solid line of FIG. 2. Then, the sheet P fed from the fixing device 34 is fed to the sheet ejection passage 36 through the fixing feed passage 35. The sheet ejection roller pair 37 pinches the sheet P fed to the sheet ejection passage 36, and is rotationally driven to eject the sheet P to the sheet ejection tray 44, and then the simplex printing ends.

Next, an example in which duplex printing is performed will be described. Similarly to the example of the simplex printing, the fixing device 34 feeds the sheet P to the sheet ejection passage 36. Then, when the duplex printing is performed, the sheet ejection roller pair 37 is rotationally driven to convey a part of the sheet P to the outside of the laser printer 100.

Then, when a trailing end of the sheet P passes through the sheet ejection passage 36, the switcher 42 swings around the swing shaft 42*a* to close the upper end of the fixing feed passage 35 as indicated by a broken line of FIG. 2. Then, almost at the same time as the upper end of the fixing feed passage 35 is closed, the sheet ejection roller pair 37 rotates in an opposite direction to a direction in which the sheet P is conveyed to the outside of the laser printer 100, and feeds the sheet P to the reverse feed passage 41.

The sheet P fed to the reverse feed passage 41 passes through the reverse feed roller pair 43, and arrives at the timing roller pair 14. Then, the timing roller pair 14 makes an attempt to find an optimal timing (synchronization) at which the toner image formed on the intermediate transfer belt 16 is transferred to a toner image untransferred face of sheet P, and feeds the sheet P to the secondary transfer separation nip.

Then, the secondary transfer roller 20 and the driving roller 18 transfer the toner image onto the toner image untransferred face of the sheet P when the sheet passes through the secondary transfer separation nip. Then, the sheet P onto which the toner image is transferred is conveyed to the fixing device 34 through the post-transfer feed passage 33.

The fixing device 34 pinches the conveyed sheet P through the fixing roller 34*a* and the pressure roller 34*b*, and fixes an unfixed toner image onto the sheet P by heating and pressurizing. Then, the sheet P onto which the toner image is fixed is fed from the fixing device 34 to the fixing feed passage 35.

The switcher 42 is at a position at which a portion around the upper end of the fixing feed passage 35 is opened at a timing at which the sheet P is fed from the fixing device 34 as indicated by a solid line of FIG. 2. Then, the sheet P fed from the fixing device 34 is fed to the sheet ejection passage 36 through the fixing feed passage. The sheet ejection roller pair 37 pinches the sheet P fed to the sheet ejection passage 36, and is rotationally driven to eject the sheet P to the sheet ejection tray 44, and then the duplex printing ends.

After the toner image on the intermediate transfer belt 16 is transferred onto the sheet P, residual toner adheres onto the intermediate transfer belt 16. Then, the belt cleaner 21 removes the residual toner from the intermediate transfer belt 16. The toner removed from the intermediate transfer belt 16 is conveyed to the powder container 10 by a waste toner conveyor, and collected in the powder container 10.

(Basic Structure of Friction Pad System)

Figure 3A:
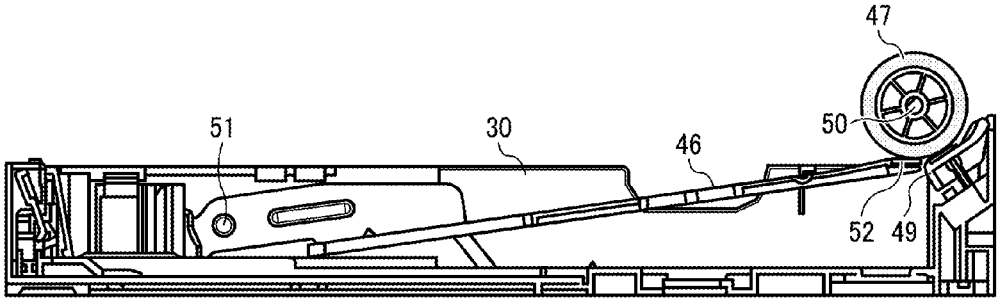
FIG. 3A is a side view of a sheet feed tray mounted to a color laser printer according to an embodiment of the present disclosure.
Figure 3B:
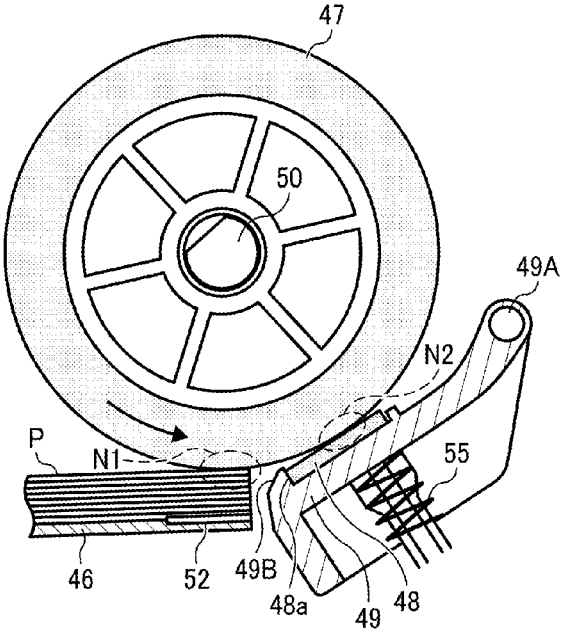
FIG. 3B is a side view of a sheet feed roller and a friction pad of a friction pad system according to an embodiment of the present disclosure.

A sheet feeding device of a friction pad system will be described with reference to FIGS. 3A and 3B. FIG. 3A is a side view of the sheet feed tray 30 which is laterally viewed. FIG. 3B is a cross-sectional view of a sheet feeding and separation part of the sheet feeding device.

The sheet feed roller 47 is arranged at the apparatus body side as illustrated in FIG. 3A. A base plate 46 and a holder 49 are arranged in the sheet feed tray 30.

The sheet feed roller 47 is prevented from rotating by the sheet-feed roller shaft 50 and a D cut or pin or the like, and supported on the apparatus body via a bearing.

The sheet-feed roller shaft 50 is extended in a direction (hereinafter, a width direction) perpendicular to a sheet face on which FIG. 3A is printed. A driving gear is attached to a shaft end of the sheet-feed roller shaft 50.

The driving gear is coupled to a driving source such as a motor through a drive connector such as a plurality of idle gears or clutches or a solenoid. Further, driving force is transmitted from the driving source to the sheet-feed roller shaft 50, and the sheet feed roller 47 is configured to rotate counterclockwise in FIG. 3A.

The sheet feed roller 47 is configured to perform an intermittent operation at a certain timing by controlling a connection time of the drive connector and a stop time of the driving source.

A surface layer portion of the sheet feed roller 47 is configured with rubber having a high friction coefficient to be able to apply certain conveyance force to the sheet P. By controlling the connection time of the drive connector and the stop time of the driving source, the sheet P is fed.

For example, the sheet feed roller may be configured to have dimensions of a diameter of 36 mm and a width of 45 mm. For the dimensions, proper sheet feed roller dimensions may be selected according to a type of sheet P corresponding to the sheet feeding device or a space in a device.

The base plate 46 of the sheet feed tray 30 is rotatably supported on a base-plate rotary shaft 51 installed in the sheet feed tray 30. The base plate 46 is consistently biased upward by a spring.

The sheet P is loaded on the base plate 46, and the uppermost sheet P contacts the sheet feed roller 47. The sheet P can be conveyed rightward in FIG. 3A by conveyance force applied by biasing force of the spring and the friction coefficient of the sheet feed roller 47.

A base plate pad 52 that is a pad material of a high friction coefficient is installed at the leading edge of the base plate 46. A certain load is applied to the lowermost sheet P. Thus, it is possible to prevent the lowermost sheet P and the two next lowermost sheets P from being multifed.

Here, if force of the spring biasing the base plate 46 is lower than a proper value, a feeding failure in which the sheet P is not conveyed occurs, and adversely, if the force of the spring biasing the base plate 46 is higher than the proper value, multifeeding in which many sheets P are conveyed occurs. Thus, it is consequential to set spring force in order to preventing the feeding failure and the multifeeding.

A friction pad (separation pad) 48 illustrated in FIG. 3B serving as a friction member is configured with a material of a high friction coefficient such as urethane foam rubber, EP rubber, silicon rubber, cork, or a compounded material thereof. Thus, by setting a friction coefficient of the friction pad 48 to be higher than a friction coefficient between the sheets, multifeeding caused by a difference between the friction coefficients is prevented.

The friction pad 48 is formed in a rectangular shape that is a simple shape in view of mass productivity, and attached to the holder 49 using a double-sided tape. The holder 49 is configured to be swingable upward and downward as a rotary shaft 49A of the holder installed downstream in the sheet feed direction is rotatably supported on the sheet feed tray 30.

A spring 55 is arranged below the holder 49, and the holder 49 and the friction pad 48 are biased upward, that is, toward a rotation center of the sheet feed roller 47 by the spring 55.

Here, a contact portion of the uppermost sheet P loaded on the base plate 46 and the sheet feed roller 47 is referred to as a "sheet feeding nip N1," and a contact portion of the friction pad 48 and the sheet feed roller 47 is referred to a "separation nip N2."

For example, even when the two sheets P fed from the sheet feeding nip N1 overlap, the two sheets P can be separated and conveyed by applying the friction load caused by the friction pad 48 to the lower one of the two sheets P at the separation nip N2.

For the separation of the sheet P, if a friction coefficient between the sheet feed roller 47 and the sheet P is assumed to be $\mu r$, a friction coefficient between the sheets P is assumed to be $\mu p$, and a friction coefficient between the sheet P and the friction pad 48 is assumed to be $\mu f$, only the lowermost sheet is separated by the friction due to a magnitude relation ($\mu r > \mu f > \mu p$) of the three friction coefficients and fed.

A low-price resin material having a friction coefficient lower than that of the friction pad 48 in order to improve the conveyance characteristic is selected as a material of the holder 49. A convex separator 49B formed as a single body with the holder 49 is formed at an upstream side of the friction pad 48. The height of the separator 49B is set to be higher than an upstream end 48*a* of the friction pad 48 by a certain level in order to prevent the leading edge of the sheet P from getting caught on the upstream end 48*a* of the friction pad 48.

The support structure of the holder 49 is not limited to a support structure that is rotatable on the rotary shaft 49A as described above. The rotary shaft 49A may be arranged on an upstream side other than a downstream side. Further, the holder 49 may be arranged to be able to perform a parallel shift in a linear manner, for example, in a rotation center of the sheet feed roller 47, for example, according to the layout of parts around the holder 49.

(Embodiment of Present Disclosure)

Figure 4A:
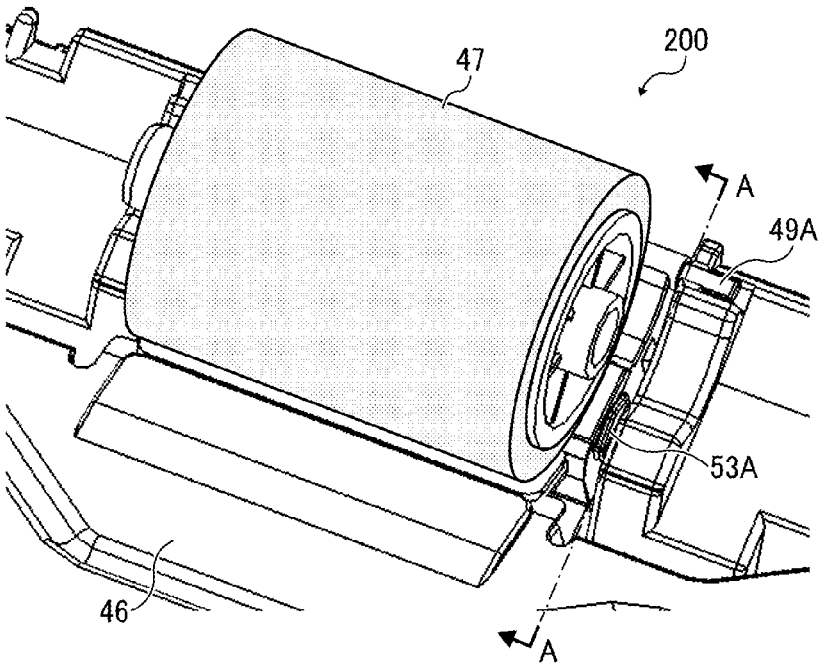
FIG. 4A is a perspective view of a sheet feeding device according to an embodiment of the present disclosure.
Figure 4B:
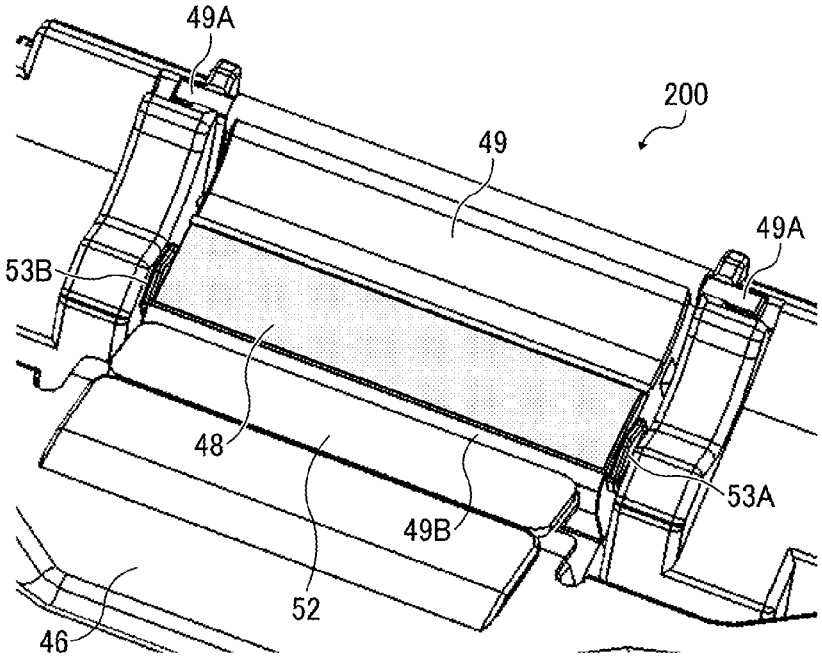
FIG. 4B is a perspective view of a holder of the sheet feeding device of FIG. 4A.
Figure 4C:
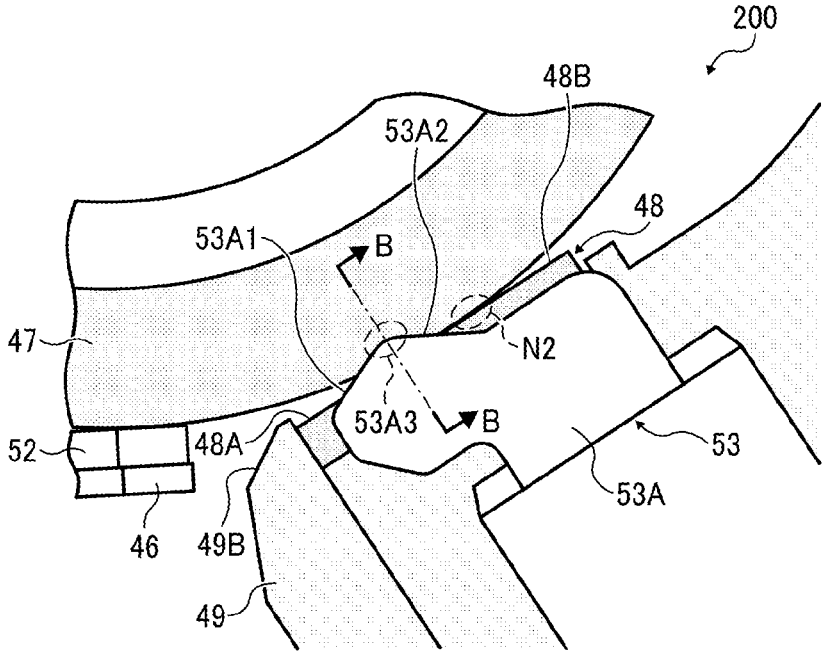
FIG. 4C is a side view of the sheet feeding device of FIG. 4A.
Figure 4D:
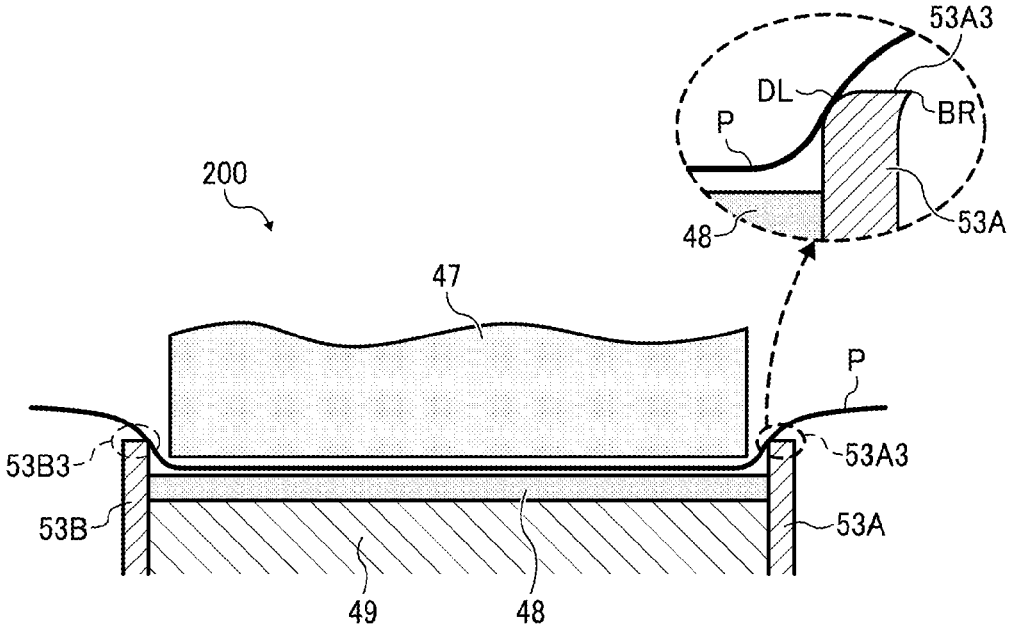
FIG. 4D is a front view of the sheet feeding device of FIG. 4A.

Next, a configuration of a separator around a friction pad 48 and a holder 49 of a sheet feeding device 200 according to an embodiment of the present disclosure will be described. FIG. 4A is a perspective view of a separator in the sheet feeding device 200 according to an embodiment of the present disclosure. FIG. 4B is a perspective view of the sheet feeding device 200 in which the sheet feed roller 47 illustrated in FIG. 4A is not omitted. FIG. 4C is a cross-sectional view of the sheet feeding device 200 cut along line A-A of FIG. 4A. FIG. 4D is a cross-sectional view of the sheet feeding device 200 cut along line B-B of FIG. 4C.

The friction pad 48 having a width direction larger than that of the sheet feed roller 47 is attached to the holder 49. Further, guides 53A and 53B that guide the conveyance of the sheet P are arranged outside both ends of the friction pad 48 in a width direction.

The guide support 53 including the guides 53A and 53B is fixed to the holder 49. The left and right guides 53A and 53B have the same shape. For the sake of convenience, the following description will proceed with only one guide 53A for the shape of the guides 53A and 53B.

In order to prevent the sheet P from passing obliquely, it is necessary to secure the positional accuracy of a pair of guides 53A and 53B in the feed direction of the sheet P. In this regard, a pair of guides 53A and 53B are formed as a single part to configure as an integrated guide support 53.

The guide support 53 is fixed to the holder 49 and follows the rotation of the holder 49. Thus, relative positions of a pair of guides 53A and 53B and the friction pad 48 are maintained.

The guides 53A and 53B are arranged upstream in the sheet feed direction further than the separation nip N2. The guides 53A and 53B have a shape illustrated in FIG. 4C (a cross section A-A of FIG. 4A).

In other words, the guide 53A (53B) has a guide shape that is convex in substantially a triangular form by a slope 53A1 at an upstream side in the sheet feed direction, a slope 53A2 at a downstream side, and an apex 53A3 smoothly connecting the two slopes.

The apex 53A3 of the guide 53A is arranged in a direction in which the sheet P is separated from the friction pad 48, that is, at a position higher than the surface of the friction pad 48. The apex 53A3 has a height at which the apex 53A3 overlaps the outer circumferential face of the sheet feed roller 47 when viewed in the axial direction of the sheet feed roller 47.

Thus, the sheet P can be supported on the separation nip N2 and both of the guides 53A and 53B, and the stick slip can be suppressed and prevented. Further, the guide apex 53A3 may be configured to have a height so that the apex 53A3 is arranged at a position lower than the outer circumferential face of the sheet feed roller 47 when viewed in the axial direction of the sheet feed roller 47. In the case of this configuration, by setting the height of the apex 53A3 to a certain height, the stick slip can be effectively suppressed and prevented.

At the time of sheet conveyance, the leading edge of the sheet P invades an upstream side surface 48A of the friction pad 48. Further, when there are many sheets P, the sheets P are separated into one or two by a load received from the upstream side surface 48A.

The sheets P separated into one or two are guided from the upstream side surface 48A of the friction pad 48 to the slope 53A1. In this case, if an angle formed by the upstream side surface 48A and the slope 53A1 is too large, the conveyance load of the sheet P is excessive, and the feeding failure occurs, and the sheet P is damaged.

Meanwhile, when the sheet P is conveyed, and the trailing end of the sheet P pulls out of the apex 53A3, if an angle formed by the slope 53A2 and the upstream side surface 48A of the friction pad 48 is too large, an impact when the sheet trailing end contacts a downstream side surface 48B of the friction pad 48 is increased, and an unpleasant noise occurs.

On the other hand, if an angle with the downstream side surface 48B of the friction pad 48 is reduced by laying the slope 53A2 down, the slope 53A2 overlaps the separation nip N2. In this case, the lower face of the sheet P is lifted up by the guides 53A and 53B, and friction force necessary to separate the sheet P is not applied by the separation nip N2, and thus multifeeding occurs. Thus, in order to prevent the occurrence of multifeeding, it is necessary to decide the position of the apex 53A3 as described above.

As described above, since a pair of left and right guides 53A and 53B are arranged on both ends of the friction pad 48, it is possible not only to hold the sheet P through the separation nip N2 but also to lift up and support the sheet P through a pair of left and right guides 53A and 53B as illustrated in FIG. 4D (a cross section B-B of FIG. 4C).

If the sheet P is lifted up by the left and right guides 53A and 53B, the sheet P is pressed against the sheet feed roller 47 side, and force of holding the sheet P by the sheet feed roller 47 is increased. Thus, even when the two sheets P are conveyed to the separation nip N2, a high load is applied to the lower sheet P, and thus multifeeding is prevented. Further, since the force of holding the sheet P is strong, a stick slip in which the sheet P intermittently vibrates can be suppressed, and the occurrence of noise can be prevented.

Figure 5:
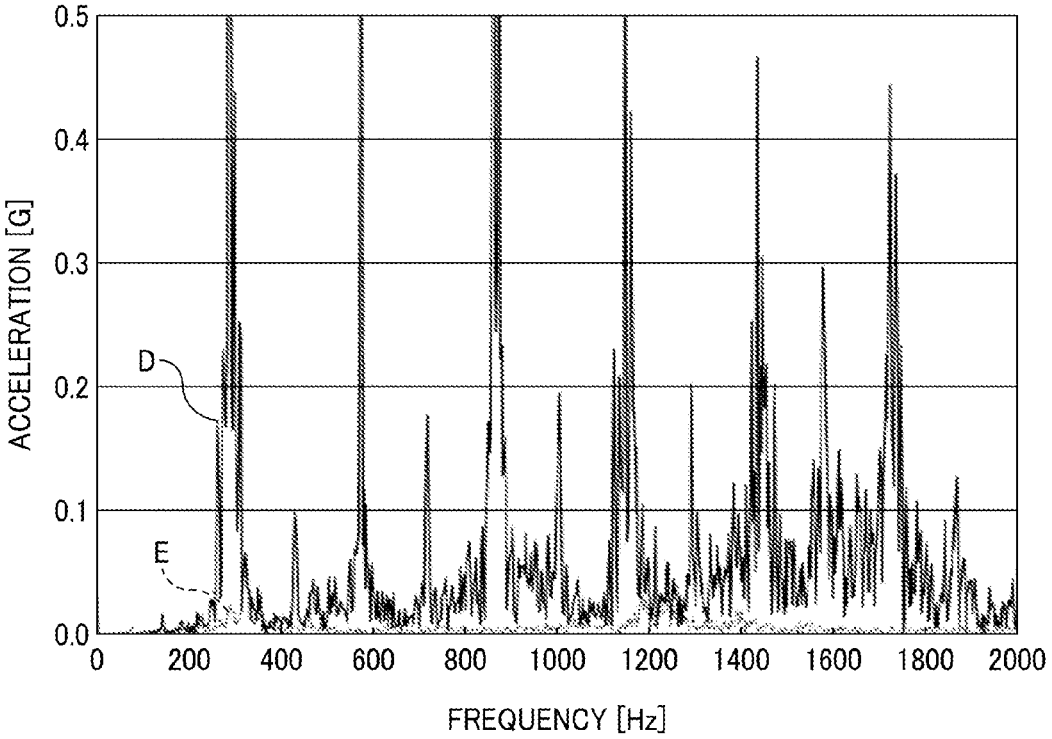
FIG. 5 is a diagram illustrating vibration acceleration test results when sheet feeding is performed in a sheet feeding device according to an embodiment of the present disclosure and a comparative example of a sheet feeding device.

A waveform of FIG. 5 is a graph obtained by performing frequency analysis based on fast Fourier transform (FFT) on vibration generated in the holder 49 at the time of sheet feeding by the sheet feed roller 47. A horizontal axis denotes a frequency [Hz], and a vertical axis denotes acceleration [G].

A waveform E indicated by a dotted line is a result of the sheet feeding device 200 according to the present embodiment, and a waveform D indicated by a solid line is a result of a comparative example of a sheet feeding device including no guides 53A and 53B. Both the sheet feeding devices have a similar configuration except the guides 53A and 53B. The height of the guides 53A and 53B was set to a guide height h (=0.6 mm) of FIG. 8 which will be described later. For the sake of convenience of description, in FIG. 5, a maximum scale value of the acceleration on the vertical axis is 0.5 [G], and a maximum scale value of the frequency is 2000 [Hz]. A portion of the waveform D larger than the maximum scale values is omitted.

The details of machinery and materials used in a test are as follows:

- a material of the friction pad 48: a urethane foam material
- a material of the holder 49: polycarbonate (PC)
- a material of the sheet feed roller 47: ethylene propylene diene monomer (EPDM)
- a diameter of the sheet feed roller 47: ϕ36 mm
- a feeding speed of the sheet feed roller 47: 60 mm/s
- a width of the separation nip N2 (a width of the sheet feed roller 47): 50 mm
- pressure of the separation nip N2: 3N
- a type of sheet: plain sheet of paper (Askul multi paper super white A4)
- a sheet entry angle: 30°
- a measuring instrument: acceleration pickup (a manufacturer: PCB Piezotronics Inc., and a format: 352C22)
- an FFT analyzer (a name: a multi data station, a manufacturer: Ono Sokki Co., Ltd., and a format: DS-2100)

As can be understood from FIG. 5, as the acceleration [G] is increased, a noise is increased. This noise is caused by the vibration of the stick slip of the sheet on the friction pad 48.

As a result of the test, in this embodiment of the present disclosure, maximum acceleration was 0.06 [G] in a frequency range of 0 to 2000 [Hz], whereas in the comparative example of the sheet feeding device, maximum acceleration was 4.71 [G] in a frequency range of 0 to 2000 [Hz].

As a result, it was confirmed that there is a vibration value difference of about 77 times between the present embodiment and the comparative example of the sheet feeding device. According to the test result of FIG. 5, the sheet feeding device of the present embodiment including the guides 53A and 53B can reduce the vibration more remarkably and apparently than the comparative example of the sheet feeding device including no guides 53A and 53B.

Thus, the guides 53A and 53B according to the present embodiment were proved to have operational effects of suppressing the vibration of the stick slip caused by friction between the friction pad 48 and the sheet P, stabilizing the operation of feeding the sheet P and the feeding accuracy, and suppressing and preventing the occurrence of noise through the vibration suppression action.

It is understood that the multifeeding and the occurrence of noise can be suppressed through the configuration of the guides 53A and 53B, but another problem arises with the increase in the force of holding the sheet P by the guides 53A and 53B. In other words, since the high load is applied to the guides 53A and 53B, if the sheet P is intermittently conveyed, the guides 53A and 53B are gradually worn. The position of the apex 53A3 changes gradually as a time passes, and a problem in that the multifeeding and noise suppression effects are finally lowered occurs.

As a method of reducing the wearing of the guides 53A and 53B, a method of increasing the width of the guide face is considered. In this case, however, since it is necessary to avoid interference between the guides 53A and 53B and peripheral parts in the movable area of the holder 49, an increase in a device size is inevitable.

Figure 6A:
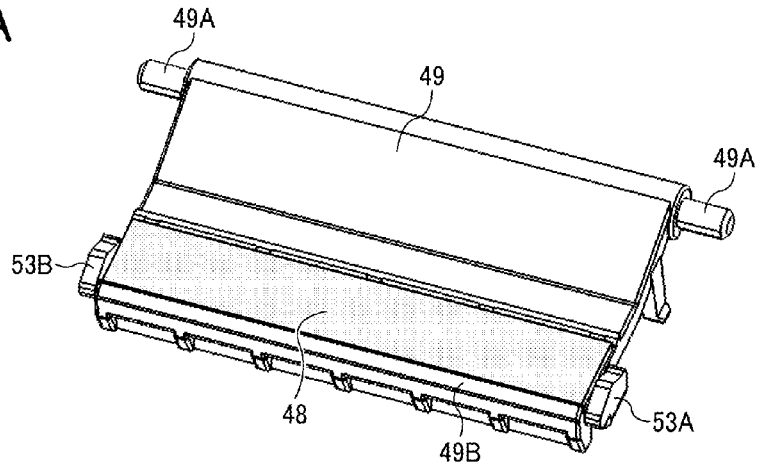
FIG. 6A is a perspective view of a holder of a sheet feeding device according to an embodiment of the present disclosure.
Figure 6B:
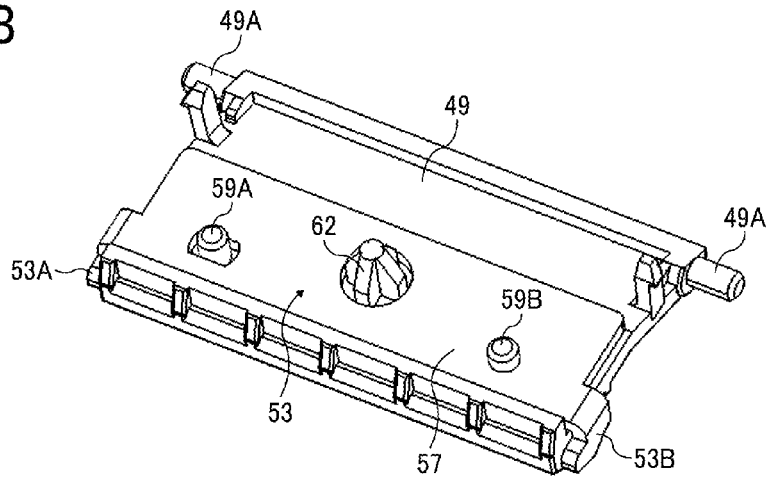
FIG. 6B is a perspective view of the holder of FIG. 6A viewed from below.

In this regard, in the present embodiment, the guide support 53 is configured as a member separated from the holder 49 as illustrated in FIG. 6B when FIG. 6A and FIG. 6B are viewed from a back face. Thus, when the guides 53A and 53B are worn, it is possible to replace the guides 53A and 53B. In addition, the guide support 53 including the guides 53A and 53B can be formed using a material having excellent wear resistance different from that of the holder 49, for example, a metallic material, a high-hardness resin material, or a highly-slidable resin material.

By configuring only the guide support 53 with the above materials in a minimum range rather than the entire configuration including the holder 49, the wear resistance effect can be obtained at a low-cost configuration.

In addition, when a metallic material is used, a manufacturing technique such as a pressing process of general steel, aluminum die-casting, or cutting is considered. In the present embodiment, the guide support 53 is formed as a single unit by a press-molded product molded by the pressing process that is low in cost and effective for mass productivity.

In a sheet-metal part using the pressing process, generally, depending on a pressing direction on the part, one face of the part is a drooped face having a smooth edge, and the opposite face thereof is a burr face in which an edge has a burr. When the sheet P is guided through the guides 53A and 53B, the sheet P is guided through the faces of the guides 53A and 53B facing both ends of the sheet feed roller 47, that is, the inner edges of the guides 53A and 53B as illustrated in FIG. 4D.

Figure 6C:
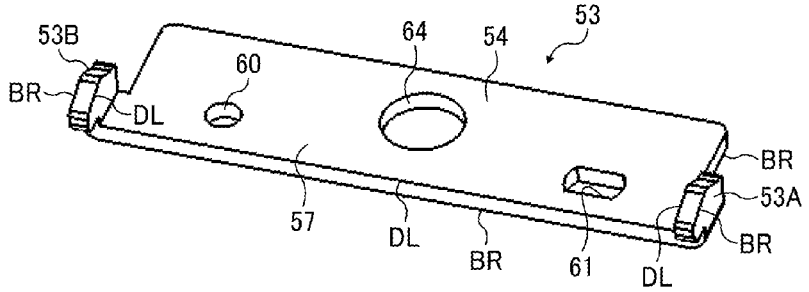
FIG. 6C is a perspective view of a guide support of the holder of FIG. 6A.

Thus, in order to prevent the feeding failure or the damage occurring when the sheet P gets stuck on the burr generated by the pressing process of the guides 53A and 53B, it is necessary to set a drooped face as an upper face 54 of the guide support 53 of FIG. 6C and set a burr face as a lower face 57. In FIG. 6C, when such a setting is performed, a droop is indicated by DL, and a burr is indicated by BR. If the sheet P comes to the upper face 54 side serving as the face with the burr BR, since it influences even the height of the guides 53A and 53B, it is necessary to perform the above setting.

Further, when steel is cut out by the pressing process, a cut section is generally configured with a shear face that is cut to be relatively flat in a first half of punching and a broken-out face that is cut to be torn off roughly in a second half of punching. By setting the drooped face and the burr face, within a sheet thickness of the guide support 53, the drooped face side serves as the shear face, and the burr face side serves as the broken-out face. Generally, each of the shear face and the broken-out face forms roughly half of the sheet thickness.

In the present embodiment, for space saving, a front portion of a sheet metal bent at a right angle is used as the guides 53A and 53B as illustrated in FIG. 4D. Thus, the sheet P can be guided through the shear face (the left half of the guide apex 53A3) that has no burr BR and is no risk of a sheet damage such as the apex 53A3 of FIG. 4D.

As can be understood from FIG. 4D, the sheet P is normally guided through the smooth shear faces (the left side of the guide apex 53A3 and the right side of a guide apex 53B3). However, due to a variation when the guide support 53 is processed or characteristics such as a curl or stiffness of the sheet P, the sheet P is likely to be guided through the broken-out face (the right side of the guide apex 53A3) having the burr BR. If the sheet P is guided through the broken-out face, the sheet damage or the sheet feeding failure is likely to occur.

In this regard, in order to prevent the sheet damage or the sheet feeding failure, as post processing after the pressing process of the guide support 53, it is desirable to make the cut section of the guide support 53 smooth through a polishing process such as buffing polishing, barrel polishing, electrolytic polishing, or chemical polishing. In addition, it is desirable to improve surface characteristics of the cut section of the guides 53A and 53B, improve the conveyance characteristic of the sheet P, and stabilize the conveyance quality by forming a thin film layer having an excellent slidability on the cut section of the guides 53A and 53B by performing a plating process, a coating process, or the like.

Further, it is possible to adjust a weight (a complex weight) of the entire holder 49 including the friction pad 48 and the guide support 53 by configuring the guide support 53 with a metallic material having a specific gravity higher than the holder 49 and changing the shape of the guide support 53.

Thus, it is possible to cause a natural frequency of the entire holder 49 serving as a complex to deviate from a vibration frequency generated by the stick slip without increasing the number of parts, and it is possible to prevent the occurrence of noise caused by a resonance.

Figure 7A:
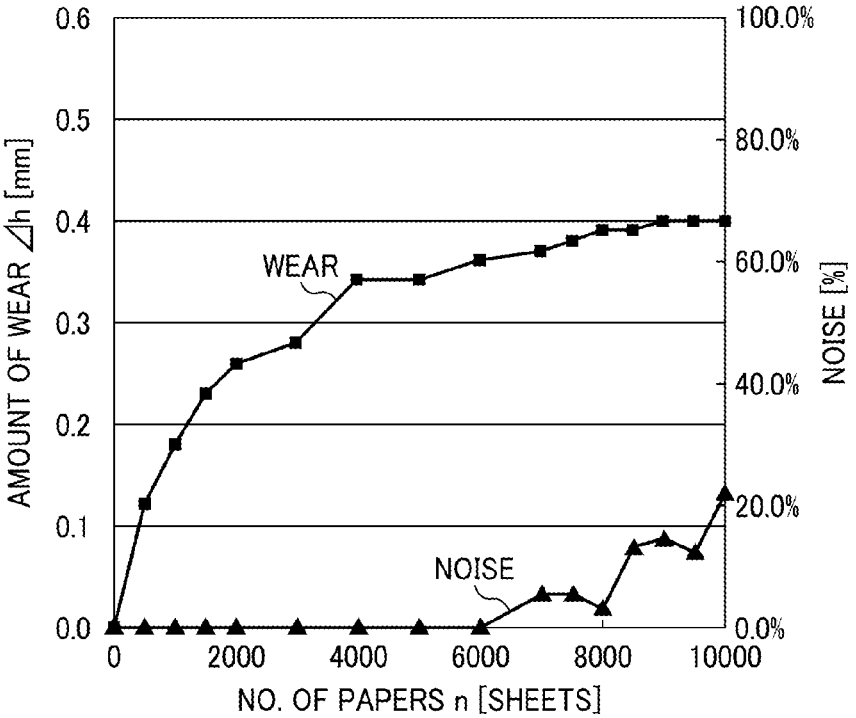
FIG. 7A is a graph of wearing amount and noise occurrence rate of a guide made of resin according to an embodiment of this disclosure.
Figure 7B:
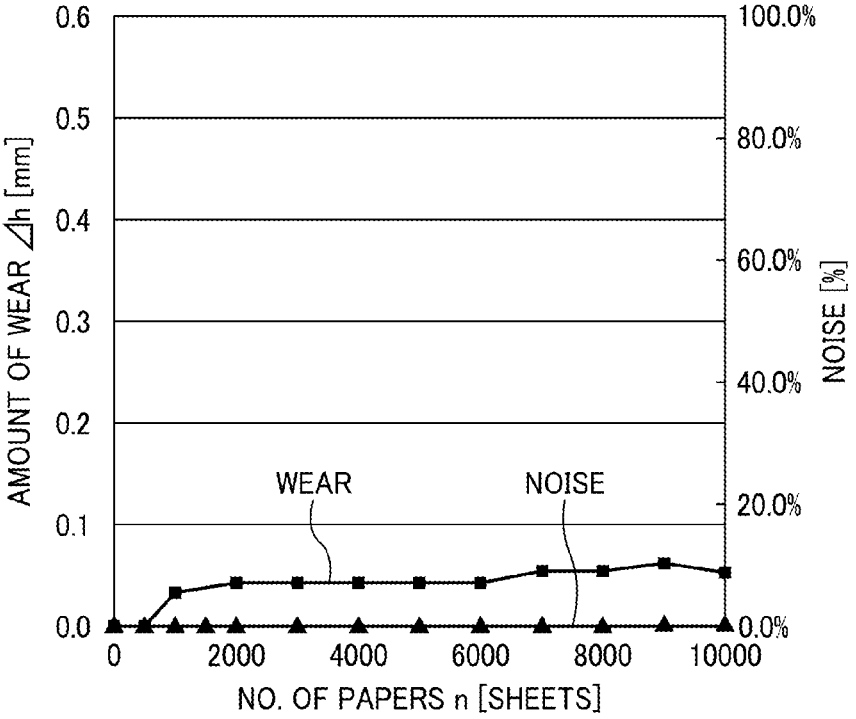
FIG. 7B is a graph of wearing amount and noise occurrence rate of a guide made of metal according to an embodiment of this disclosure.

FIGS. 7A and 7B illustrate results of verifying wear resistance effects of a guide support 53 made of metal and a guide support 53 made of resin through a sheet passing durability test, a wearing amount and a noise occurrence frequency of the guides 53A and 53B is represented by a relation with the number of passing sheets. FIG. 7A illustrates a wear resistance effect in a sheet feeding device using the guide support 53 made of resin. FIG. 7B illustrates a wear resistance effect in a sheet feeding device using the guide support 53 made of a sheet plate.

A horizontal axis of FIGS. 7A and 7B indicates the number n of passed plain sheets of paper of an A4 size. A vertical axis (left) at a left side indicates a wearing amount Δh of one of the guides 53A and 53B that is large in wearing. A vertical axis (right) at a right side indicates a noise occurrence frequency.

Figure 8:
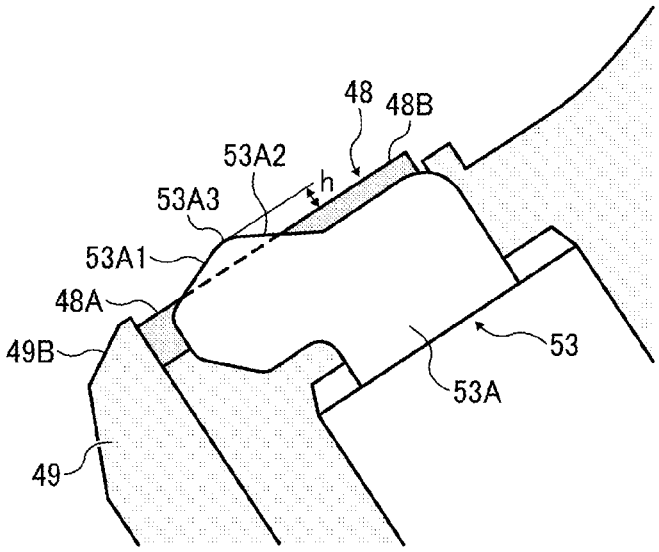
FIG. 8 illustrates an enlarged side view of a guide used in a sheet passing durability test according to an embodiment of the present disclosure.

The guide height h serving as the height from the surface of the friction pad 48 to the apex 53A3 of the guide support 53 is used as the wearing amount Δh as illustrated in FIG. 8.

First, the guide height h is measured in advance before the sheet passing durability test starts. Then, the guide height is similarly measured each time 500 sheets or 1000 sheets are passed. If an initial guide height h is indicated by h0, the wearing amount Δh is obtained by calculating a difference from an initial state, that is, Δh=h0−h.

In the present embodiment, a designed value of the guide height h is 0.6 mm. If the wearing amount is 0.6 mm, it indicates that the guide height h is 0 mm, that is, the guide is completed worn. Further, a highly smooth sheet in which a noise extracted based on a result of a sheet passing test that is performed in advance is likely to occur is used for the noise occurrence frequency.

As a procedure, a plain sheet of paper is subjected to sheet passing durability, a certain number of highly smooth papers are passed at each plot (a point at which the guide height h is measured) of a graph, and the noise occurrence frequency is checked. As can be understood from FIG. 7A, in the guide support 53 made of resin, the wearing amount abruptly increases between the test start and 2000 sheets. Thereafter, a change in the wearing amount decreases, but the wearing steadily increases.

The reason is because since a largest load is applied to the guides 53A and 53B in the initial state in which the guide height h is high, the wearing abruptly progresses in the initial state, and the load and the wearing are reduced with the decrease in the guide height h. Further, referring to a noise occurrence rate, no noise occurs in passing sheets of up to up to 6000, and a noise starts to occur from a point in time at which the number of passing sheets reaches 7000, and the wearing amount reaches 0.37 mm.

In other words, it was confirmed that with the progress of the wearing, the force of holding the sheet P through the guides 53A and 53B is reduced, and thus the noise occurrence frequency increases. On the other hand, in the case of the guide support 53 of FIG. 7B made of the steel plate, slight wearing occurs in first 1000 passing sheets, but little wearing progresses after that.

Even at a point in time at which 10000 passing sheets have been passed, wearing of merely 0.05 mm from the initial state occurs, and no noise occurs. According to the above result, the guide support 53 made of the steel plate is larger in a noise occurrence suppression effect than the guide support 53 made of resin.

In addition, based on the above result, the number n of passing sheets in which a noise starts to occur in the case of the guide support 53 made of the steel plate is estimated. As a method, since the wearing amount Δh tends to vary largely in the initial state and thereafter converge steadily as can be understood from the results of FIGS. 7A and 7B, data of FIG. 7B was first approximated to a logarithmic function (Formula (1) which will be described later).

Then, it is understood from the result of FIG. 7A that a noise occurs at a point in time at which the wearing amount Δh reaches 0.37 mm. Thus, in the case of the steel plate, a noise is assumed to occur at Δh=0.37 mm, and the number n of passing sheets was obtained using Formula (1).

Formula (1) is as follows based on the result illustrated in FIG. 7B:

$$\Delta h = 0.0097\mathrm{Ln}(n) - 0.038 \qquad \text{Formula (1)}$$

Here, if n is obtained at Δh=0.37 (mm), n=4.8×1017 (sheets) is obtained.

Based on this result, it is possible to estimate that no noise occurs when the guide support 53 made of the steel plate is practically used.

Figure 9:
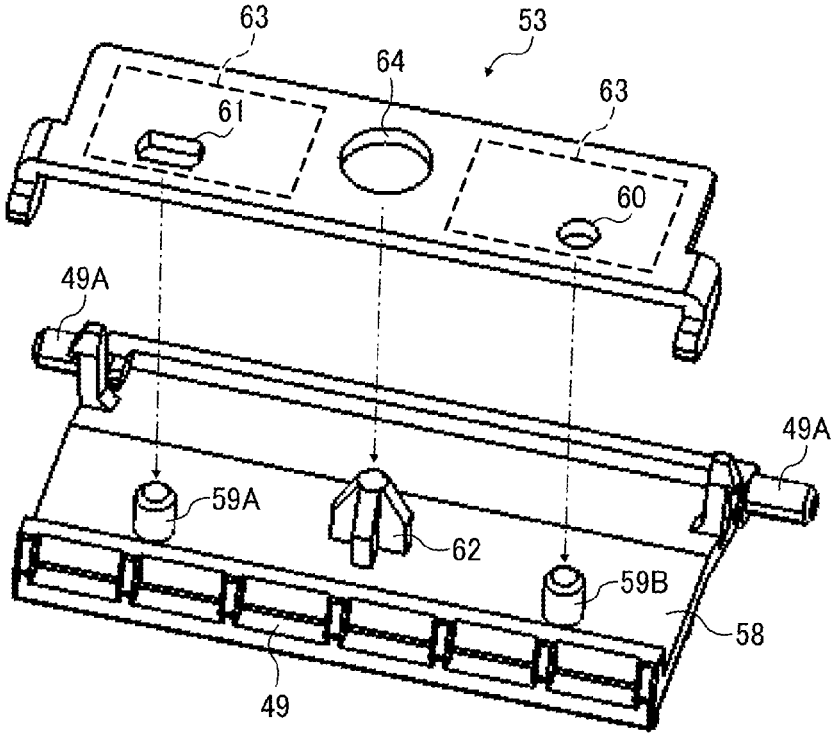
FIG. 9 is a perspective assembly diagram of a sheet feeding device according to an embodiment of the present disclosure.

Next, a configuration of attaching the guide support 53 to the holder 49 will be described. FIG. 9 is an assembly diagram of the guide support 53 and the holder 49.

Bosses 59A and 59B for positioning the guide support 53 are formed on a lower face 58 of the holder 49. Meanwhile, a positioning hole 60 and an oval hole 61 for rotation prevention are formed on the guide support 53.

The guide support 53 is attached such that the bosses 59A and 59B are fitted into the positioning hole 60 and the oval hole 61 of the guide support 53. The positions in the feed direction and the width direction of the sheet P are regulated by the bosses 59A and 59B.

A boss 62 of a cross shape is to guide a spring. A hole 64 into which the cross boss 62 is inserted is formed on a central portion of the guide support 53 in the width direction. The hole 64 is formed to have an inner diameter that is larger than an outer diameter of the cross boss 62 by a certain gap, and positioning is not performed in the cross boss 62.

On the upper face 54 of the guide support 53 connecting a pair of guides 53A and 53B, a pair of left and right double-sided tapes 63 are attached around the positioning hole 60 and the oval hole 61. The lower face 58 of the holder 49 is bonded to the upper face 54 of the guide support 53 using the double-sided tape 63. Since the positioning place is close to the bonded place as described above, an effect of suppressing vibration and increasing fixing force is obtained. This makes it possible to perform positioning of the guides 53A and 53B and the friction pad 48 and the sheet feed roller 47.

Here, the reason why the guide support 53 is attached to the lower face 58 rather than the upper face of the holder 49 will be described. Unlike the embodiment of the present disclosure, the guide support 53 may be fixed to the upper face of the holder 49, and the friction pad 48 may be attached to the upper face 54 of the guide support 53.

The reason why the guide support 53 is attached to the lower face 58 of the holder 49 instead of the above-described configuration is because the positional accuracy of the friction pad 48 is secured. Hereinafter, a mount structure of the present embodiment is referred to as a "lower-face mount structure."

In other words, if the guide support 53 is fixed to the upper face of the holder 49, the positions of the guides 53A and 53B and the friction pad 48 in the height direction change according to a variation in the sheet thickness of the guide support 53 or a floating amount when the guide support 53 is attached. Since the holder 49 is supported on the rotary shaft 49A, an inclination angle of the friction pad 48 also changes due to a dimension variation.

An angle at which the sheet P enters the friction pad 48 significantly influences the sheet feeding performance such as the multifeeding or the feeding failure. Thus, in the present embodiment, the "lower-face mount structure" that is not influenced by the inclination angle in the height direction is employed.

Further, the double-sided tape 63 serving as a tool of fixing the guide support 53 to the holder 49 has an effect of suppressing a noise as well. Since the double-sided tape 63 is an elastic body, there is an effect of decaying the vibration through the double-sided tape 63 although a vibration occurs in the friction pad 48 and is propagated to the holder 49 when the sheet P is conveyed.

Since characteristics of the vibration decaying effects differ according to a thickness or a material of the double-sided tape 63, it is desirable to select an optimal double-sided tape according to a machine type.

Here, the double-sided tape has a problem related to fixing reliability as a time passes. When excessive force is applied to the guides 53A and 53B of the guide support 53, in the lower-face mount structure, there is a possibility that the guide support 53 will be peeled off and fall from the holder 49. Particularly, in the present embodiment, since the force of holding the sheet P is generated by the guides 53A and 53B, force consistently works in a direction in which the guide support 53 is peeled off at the time of sheet conveyance.

Figure 10A:
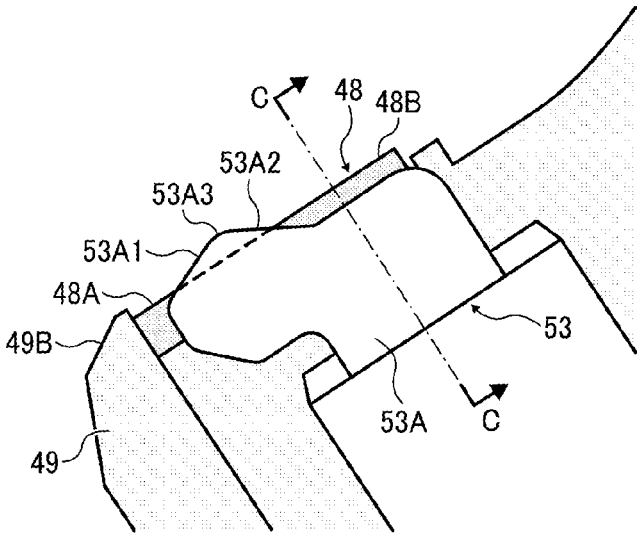
FIG. 10A is an enlarged side view of a guide of a sheet feeding device according to an embodiment of the present disclosure.
Figure 10B:
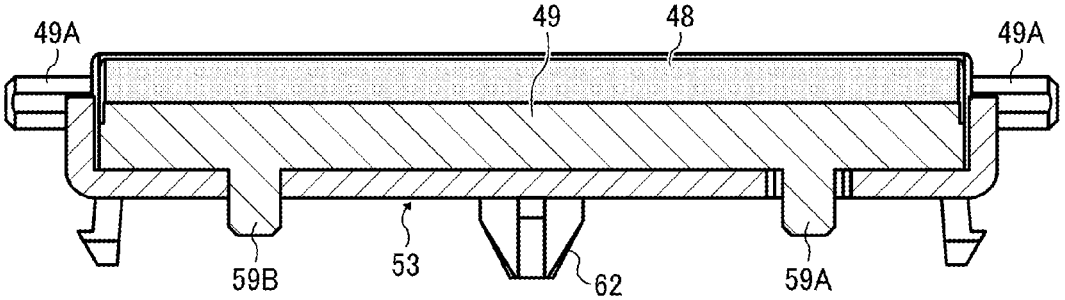
FIG. 10B is a cross-sectional view of the sheet feeding device cut along line C-C of FIG. 10A.

In order to solve this problem, it is desirable to fix the guide support 53 through thermal welding. In other words, after the guide support 53 is fixed through the double-sided tape, the leading edges of the positioning bosses 59A and 59B protruding from the guide support 53 are heated and welded as illustrated in FIG. 10B. As a result, it is possible to firmly fix the guide support 53, and even in the lower-face mount structure, the guide support 53 is not peeled off from the holder 49 as a time passes.

(First Variation)

Figure 11:
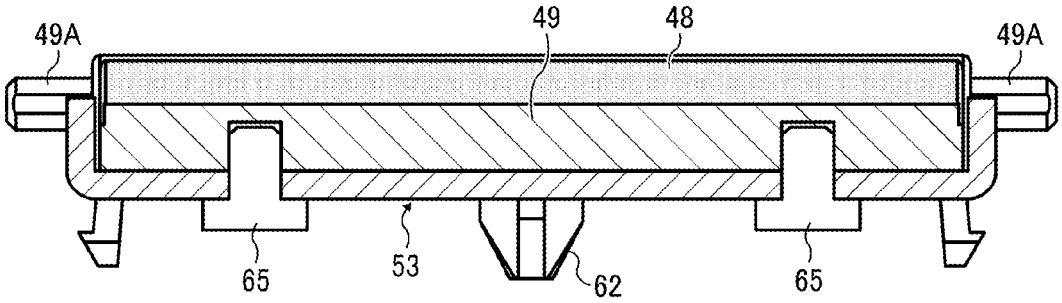
FIG. 11 is a cross-sectional view of a first variation of a holder of a sheet feeding device according to an embodiment of the present disclosure.

Next, a first variation of the sheet feeding device 200 will be described with reference to FIG. 11. FIG. 11 is a cross-sectional view corresponding to the cross-sectional view cut along line B-B of FIG. 4C in the state in which the guide support 53 is fixed to the holder 49. In the above embodiment, the guide support 53 is fixed to the holder 49 using the double-sided tape, but this fixing method has a problem related to replacement of the guide support 53.

One of the reasons why the guide support 53 is a member separate from the holder 49 is because the guide support 53 can be replaced as described above. However, if the guide support 53 is fixed by the double-sided tape, a slight adhesive deposit occurs when the guide support 53 is peeled off.

If there is an adhesive deposit, the guide support 53 floats when the user attaches a new guide support 53. In this case, the height positions of the guides 53A and 53B are misaligned.

The fixing using the double-sided tape has a problem as described above. Meanwhile, when the thermal welding is performed, it is difficult to replace the guide support 53. In order to solve this problem, a configuration of fixing the guide support 53 using a screw as illustrated in FIG. 11 is effective.

Referring to FIG. 11, the positioning bosses 59A and 59*b* illustrated in FIG. 9 are formed in certain positions, and the guide support 53 is fixed using a fastener 65 such as a screw. Thus, even when the sheet feeding failure occurs, for example, due to the wearing of the guides 53A and 53B, the user can easily replace the guide support 53.

(Second Variation)

Figure 12:
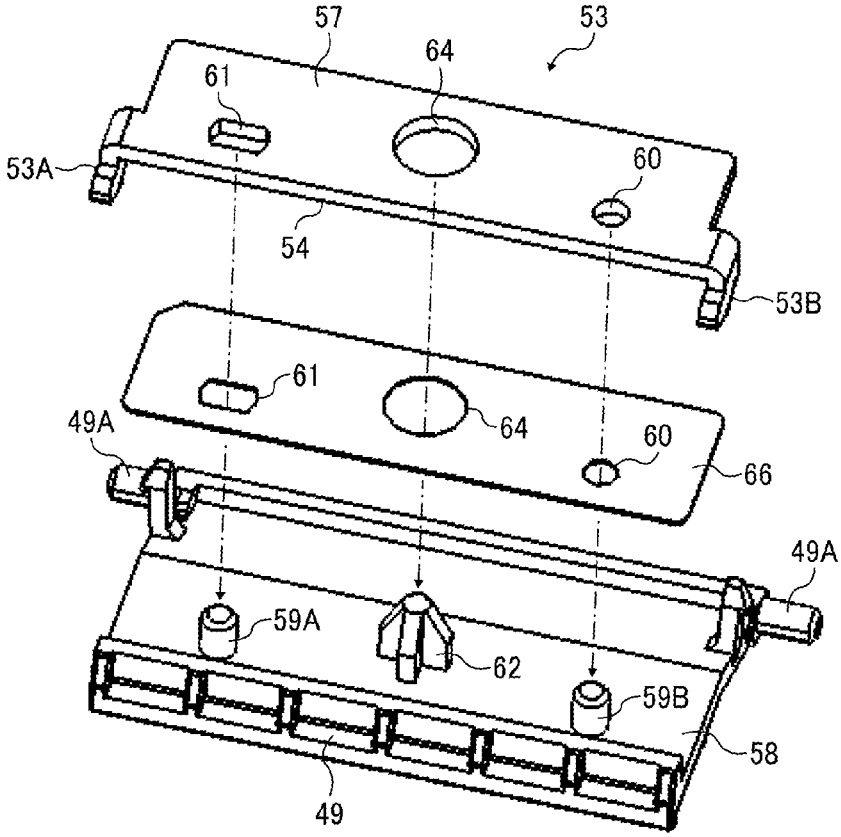
FIG. 12 is a cross-sectional view of a second variation of a holder of a sheet feeding device according to an embodiment of the present disclosure.

A second variation of the sheet feeding device 200 will be described with reference to FIG. 12. FIG. 12 is an assembly diagram of the holder 49 and the guide support 53. In the second variation, a spacer 66 serving as an adjuster is used to adjust the positions of the guides 53A and 53B.

The spacer 66 may be made of a sheet metal, similarly to the guide support 53 but may be made of resin since there is no wear resistance. A positioning hole 60, an oval hole 61, and a hole 64 into which the cross boss 62 is inserted are formed in the spacer 66, similarly to the guide support 53. In a state in which these holes are aligned with the holes of the guide support 53, the spacer 66 is interposed between the lower face of the holder 49 and the guide support 53.

The reason of using the spacer 66 is as follows. In other words, the force of holding the sheet P is generated by the guides 53A and 53B to prevent the multifeeding or the occurrence of noise as described above. However, as can be understood from the result of FIG. 7A, the noise occurrence suppression effect significantly varies according to the height position of the apex 53A3 of the guide 53A.

In the case of a sheet that is commonly used, an ideal height position for the height position of the guide apex 53A3 can be decided by performing the sheet passing test. However, even at the ideal height position, there is a possibility that a sheet will be folded or damaged according to a sheet state.

In other words, in the case of some coarse sheets, for example, in the case of sheets in which a large burr is caused by cutting when sheets are manufactured, the burr is likely to get caught on the guides 53A and 53B, and the sheet is likely to be folded or damaged. Further, if a special paper having extremely high hardness is used, the feeding failure is also likely to occur according to the load of the guides 53A and 53B.

In this regard, in the second variation, even when a coarse sheet or a special sheet is used, a configuration having no sheet feeding failure is proposed. In other words, in order to solve the above problem, it is desirable to adjust the height h illustrated in FIG. 8.

There are two types of adjusting methods. A first method is a method in which the user reassembles and uses a plurality of types of guide support 53 according to a purpose of printing, a used sheet, or the like.

In other words, a plurality of types of guide supports 53 that differ in a height dimension from the upper face 54 of the guide support 53 attached to the holder 49 to the guide apex 53A3 are prepared in advance. Then, an optimal guide support 53 is selected and used according to a purpose, a used sheet, or the like.

A second method is a method in which the height h of FIG. 8 is adjusted by inserting the spacer 66 illustrated in FIG. 12 between the guide support 53 and the holder 49. In the case of this method, the height h can be finely adjusted by assembling a plurality of spacers 66. Thus, the number of types of height adjustable at a lower cost is increased to be larger than that in the first method, and thus an adjustment according to a sheet can be easily performed.

Further, when the wearing of the guides 53A and 53B caused by passing of time is considered, one or more spacers 66 are inserted at an initial state as illustrated in FIG. 12. Then, when the wearing progress, and a noise occurs, a necessary number of spaces are taken out. As a result, it is possible to reset the guide height h to be as high as in an initial condition, and a longer lifespan is expected.

As described above, according to an embodiment or a variation of the present disclosure, the guide support is attached to the side opposite to the side of the holder at which the friction pad is held. Further, the pair of guides to raise the sheet from the surface of the friction pad are arranged at the guide support. Thus, even when the guide is worn by friction with the sheet, by replacing the guide support including the guide or adjusting the attachment position of the guide support with respect to the holder, the sheet feeding device can be continuously used. Such a configuration prevents the lifespan of the sheet feeding device from being reduced due to the wearing of the guide.

Further, since the guide support with the guide can include a material different from that of the holder in view of the wear resistance, the wearing of the guide can be further reduced by a wear resistant material. In addition, since the guide support is attached to the side opposite to the side of the holder at which the friction member is held, the method of attaching the friction member can be prevented from being limited by the guide support.

The embodiments and variations of the present disclosure has been described above, but the present disclosure is not limited to the above embodiments and variations, and various variations can be obviously made within the scope of the technical spirit of claims. For example, in the above embodiment, the guides 53A and 53B are arranged at the upstream side of the separation nip N2 in the feed direction, but the guides 53A and 53B may be arranged at the downstream side of the separation nip N2 in the feed direction as well as the upstream side of the separation nip N2 in the feed direction. Further, the guides 53A and 53B may be arranged at both the upstream side and the downstream side of the separation nip N2.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A sheet feeding device, comprising:

a rotary feeder configured to contact a first side of a sheet to feed the sheet downstream along a feed passage in a sheet feeding direction;

a friction pad, opposing the rotary feeder with the feed passage, between the rotary feeder and the friction pad to form a separation nip, the friction pad having a first side facing the separation nip and a second side opposite the first side of the friction pad;

a holder on the second side of the friction pad and having a top surface holding the friction pad and a bottom surface under the top surface of the holder;

a guide support on the bottom surface of the holder; and a pair of guides on the guide support on each side of the friction pad in a direction orthogonal to the sheet feeding direction and configured to contact a second side of the sheet facing the friction pad to raise the sheet from a surface of the friction pad.

2. The sheet feeding device according to claim 1, wherein the pair of guides includes a material harder than the holder.

3. The sheet feeding device according to claim 2, wherein each of the pair of guides and the guide support includes a material having a specific gravity higher than a specific gravity of the holder.

4. The sheet feeding device according to claim 2, wherein the pair of guides and the guide support are a press molded product formed as a single unit, and a first side of the guide support facing the holder has a smooth edge and a second side of the guide support opposite the first side has a sharp edge.

5. The sheet feeding device according to claim 2, wherein the guide support includes a face connecting the pair of guides and bonded to the holder via a double-sided tape.

6. The sheet feeding device according to claim 2, wherein the guide support is configured to be removably fastened to the holder with a fastener.

7. The sheet feeding device according to claim 2, wherein the guide support includes a face connecting the pair of guides and a part of the holder is welded to the face.

8. The sheet feeding device according to claim 1, wherein each of the pair of guides and the guide support includes a material having a specific gravity higher than a specific gravity of the holder.

9. The sheet feeding device according to claim 1, wherein the pair of guides and the guide support are a press molded product formed as a single unit, and a first side of the guide support facing the holder has a smooth edge and a second side of the guide support opposite the first side has a sharp edge.

10. The sheet feeding device according to claim 1, wherein the guide support includes a face connecting the pair of guides and bonded to the holder via a double-sided tape.

11. The sheet feeding device according to claim 1, wherein the guide support is configured to be removably fastened to the holder with a fastener.

12. The sheet feeding device according to claim 1, wherein the guide support includes a face connecting the pair of guides and a part of the holder is welded to the face.

13. The sheet feeding device according to claim 1, further comprising an adjuster having a set thickness and interposed between the holder and the guide support.

14. The sheet feeding device according to claim 1, further comprising a plurality of guide supports differing in height from a mount face of the guide support configured to be mounted to the holder to an apex of one of the pair of guides, wherein one of the plurality of guide supports is selectably attached to the holder.

15. The sheet feeding device according to claim 1, wherein the guide support includes a polished guide.

16. The sheet feeding device according to claim 1, wherein the guide support includes a guide having a thin film layer.

17. A sheet feeding device according to claim 1, wherein the pair of guides are upstream from the separation nip in the sheet feeding direction.

18. The sheet feeding device according to claim 1, wherein each of the pair of guides includes an apex in a portion overlapping an outer circumferential face of the rotary feeder when viewed in an axial direction of the rotary feeder.

19. An image forming apparatus, comprising:

the sheet feeding device according to claim 1;

an image forming device configured to form an image on the sheet fed with the rotary feeder; and a sheet ejector configured to eject the sheet on which the image is formed with the image forming device to an outside of the image forming apparatus.

20. The image forming apparatus according to claim 19, wherein the image forming apparatus is a multifunction peripheral in which two or more of a copier, a facsimile machine, a printer, a printing press, an inkjet recording apparatus, and an image reading device are combined.

* * * * *